United States Patent [19]

Ueda et al.

[11] Patent Number: 4,920,380

[45] Date of Patent: Apr. 24, 1990

[54] SURFACE POTENTIAL CONTROL DEVICE OF PHOTOCONDUCTIVE MEMBER

[75] Inventors: Masahide Ueda; Yoshihiro Hanada, both of Osaka, Japan

[73] Assignee: Minolta Camera Kabushiki Kaisha, Osaka, Japan

[21] Appl. No.: 226,056

[22] Filed: Jul. 29, 1988

[30] Foreign Application Priority Data

Jul. 31, 1987 [JP] Japan ..... 62-193085
Oct. 23, 1987 [JP] Japan ..... 62-268892

[51] Int. Cl.[5] ..... G03G 15/02; G03G 21/00

[52] U.S. Cl. ..... 355/219; 355/204; 355/221; 355/225

[58] Field of Search ..... 355/216, 219, 204, 208, 355/225, 221; 361/230, 235; 250/324, 325, 326

[56] References Cited

U.S. PATENT DOCUMENTS 3,604,925 12/1971 Snelling ..... 355/216 X
4,019,102 4/1977 Wallot ..... 355/219 X
4,290,690 9/1981 Noda et al. ..... 355/221 X
4,353,970 10/1982 Dryczynski et al. ..... 355/219 X
4,480,909 11/1984 Tsuchiya ..... 355/221
4,512,652 4/1985 Buck et al. ..... 355/219
4,757,345 7/1988 Ohashi et al. ..... 355/219

FOREIGN PATENT DOCUMENTS 59-37500 9/1984 Japan .

*Primary Examiner*—A. T. Grimley
*Assistant Examiner*—Sandra Hoffman
*Attorney, Agent, or Firm*—Burns, Doane, Swecker & Mathis

[57] ABSTRACT

When a photoreceptor provided in an image forming apparatus is electrified for image formation, the output of a charger starts with a different value from a predetermined value and it is controlled to gradually match up to the predetermined value. It is also controlled in a way to start with a lower value than a predetermined value corresponding to the time a charger suspended its operation and gradually match up to the predetermined time. Such control is carried out by controlling grid voltage which flows into grid electrode disposed between a photoreceptor and wire electrode provided for discharging.

14 Claims, 12 Drawing Sheets

SURFACE POTENTIAL CONTROL DEVICE OF PHOTOCONDUCTIVE MEMBER

BACKGROUND OF THE INVENTION

The present invention relates to a device which controls electric potential on the surface of photoconductive member for use in an image forming apparatus of electrophotographic copying machines, laser beam printers and the like, and more particularly to a device which controls electric potential on the surface of photoconductive member by controlling output of charging means.

Heretofore, various devices have been introduced as a mode of charging means which provide the surface of photoconductive member with uniform density of electric charge by impressing high voltage on charging wires thereby generating corona discharge.

However, a photoconductive member which encounters great light fatigue and possesses attenuation characteristic like the one provided with selenium as photoconductive member can not regularize charged electric potential in the area of developing process even if uniform density of electric charge is given in the process of electrification since the power for maintaining the electric charge decreases corresponding to light fatigue.

Accordingly, a control device is disclosed, for example, in Japanese Published Examine Patent Application No. 37500/1984. The device is arranged to stabilize the power of maintaining electric charge at a lower value by exposing a photoconductive member uniformly prior to image formation while taking longer exposure time according to the time the device is left in active for image forming process.

However, prior to image forming operation, preliminary treatment for photoconductive sensitivity adjustment is done after a print switch is turned on, by which the time required for image formation varies depending how long the device suspended its action. Especially when there was a long suspension of machine operation, a considerably longer period of time is required for the first image forming operation.

SUMMARY OF THE INVENTION

The main object of the present invention is to provide a device capable of controlling electric potential on the surface of photoconductive member for obtaining stabilized density of image and speedily start image forming action even after a long suspension of machine operation.

Another object of the present invention is to provide a device capable of controlling electric potential on the surface of photoconductive member for quickly obtaining good quality images without waiting for stabilization of charged potential caused by light fatigue. Irrespective of light fatigue on the photoconductive member, charged potential of the photoconductive member can always be maintained at a certain value for regulating image density by controlling charged output of charging means at a predetermined value. When the time the machine suspended its operation for a long period of time after previous copying operation, an initial charged output is controlled to set at a lower value according to the time the machine suspended its action.

Still another object of the present invention is to provide a device capable of controlling electric potential on the surface of photoconductive member for quickly obtaining good quality images without waiting for stabilization of charged potential caused by light fatigue. The device is designed to control charged output of charging means at a predetermined value, and when the machine suspended its operation for a long period of time after previous copying operation, an initial charged output is controlled to set at a lower value according to the time the machine suspended its operation thereafter gradually raising the charged output to match up to a predetermined value so that the charged potential of the photoconductive member can always be maintained at a certain value irrespective of time difference in the suspended time of machine operation thus regulating image density.

Further objects and features of the present invention will be apparent from the following description, reference being had to the accompanying drawing wherein preferred embodiments of the present invention are clearly shown.

BRIEF DESCRIPTION OF THE DRAWINGS

Like parts are given like reference numbers throughout embodiments of the present invention.

DETAILED DESCRIPTION OF THE PRESENT INVENTION

Embodiments of the present invention will be described with reference to the accompanying drawings.

Figure 1:
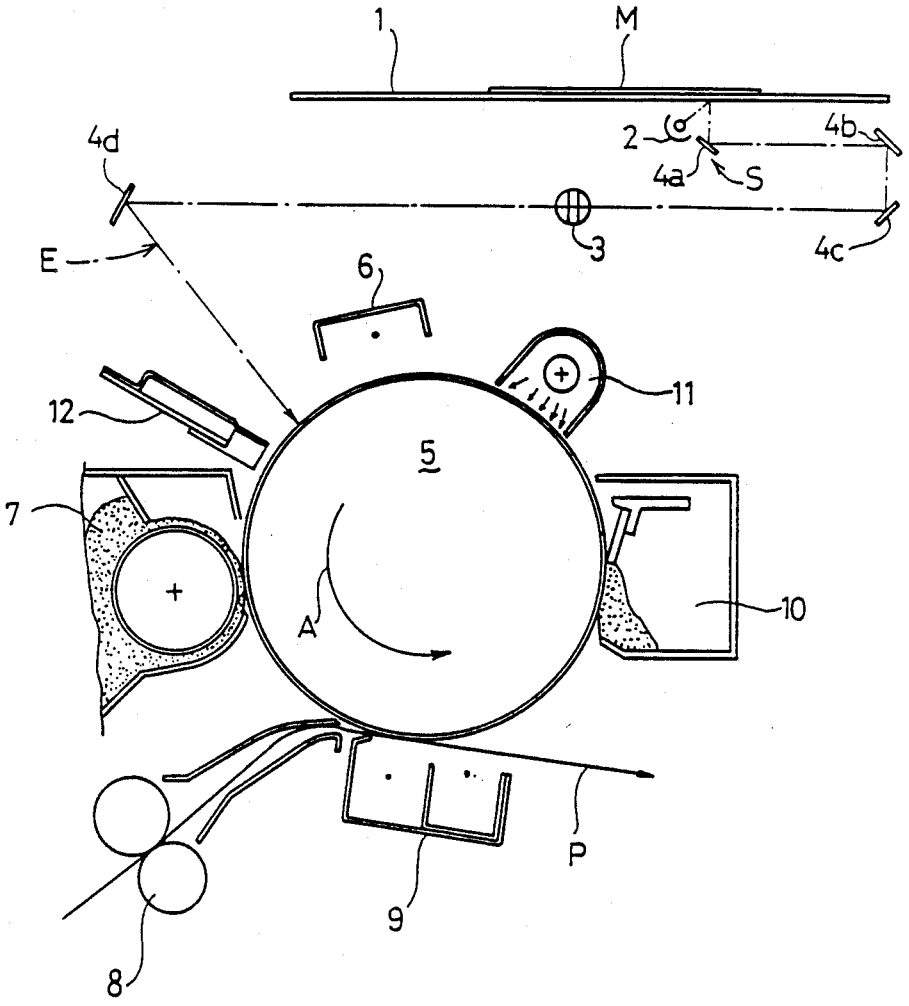
FIG. 1 is a structural view of the main part of copying machine to which the present invention is applied.

FIG. 1 shows a structural view of an electrophotographic copying machine to which the present invention is applied.

A document M placed on a document support table 1 made of glass and the like is irradiated by an exposure lamp 2. The reflected light from the document M is projected on the circumferential surface of a photoconductive drum 5 through an exposure apparatus E comprised of a lens 3 and a plurality of mirrors 4a–4d.

A scanning apparatus S comprised of an exposure lamp 2 and a first mirror 4a is designed to scan the document M by moving to the direction of left hand side in the figure by a driving mechanism (not shown). An image of the document M scanned by the scanning apparatus S is projected onto the photoconductive drum 5 which is rotating to the direction indicated by arrow A and forms an electrostatic latent image thereon.

Around the photoconductive drum 5, there are disposed a charger 6 which charges the surface of the drum uniformly, a developing unit 7 for visualizing the electrostatic latent image by toner, transfer-separation chargers 9 which transfer the visualized image on a transfer sheet P transported via timing rollers 8 and separate the transfer sheet P from the photoconductive drum 5, a cleaning device 10 for removing residual toner adhered to the surface of the photoconductive drum 5 and a main eraser 11 for extinguishing electric charge on the photoconductive drum 5 after transferring the visualized image on the transfer sheet P. The developing unit 7 of the copying machine is designed to develop an electrostatic latent image by regular developing mode by toner to the portion where electric charge is present on the photoconductive drum 5. In front of the developing unit 7, a suberaser 12 is disposed for erasing the electric charge on the portion between images, i.e. the portion excepting the electrostatic image. Thus, unnecessary consumption of toner is saved.

Figure 2:
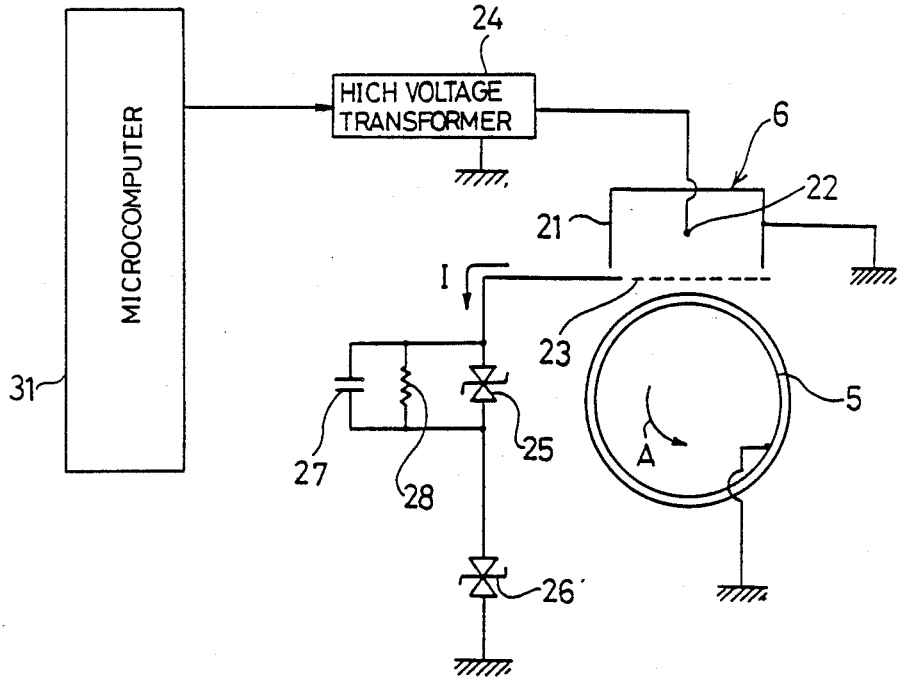
FIG. 2 shows a structural view of charged potential control device of the first embodiment of the present invention.

Detailed structure of the charger 6 of the copying machine will now be described referring to FIG. 2. The charger 6 is provided with stabilizers 21, a charging wire 22 and a grid 23. The stabilizer 21 is grounded and the charging wire 22 is connected with a high voltage transformer 24 which is controlled by a microcomputer 31. The grid 23 is disposed between the charging wire 22 and the photoconductive drum 5 and is grounded through first varistor 25 and second varistor 26 connected in series. A condenser 27 and a resistance 28 are connected with the first varistor 25 in parallel. The grid 23 is arranged for the purpose of controlling the charged potential on the photoconductive drum 5 by limiting with its voltage the amount of electric charge flowing to the photoconductive drum 5 from the charging wire 22.

With the mechanism described above, once the copying machine starts its copying operation, the photoconductive drum 5 is driven for rotation in the direction of arrow A, and the high voltage transformer 24 is turned on by command of the microcomputer 31 after reaching a predetermined circumferential speed, and the corona electric discharge start from the charging wire 22. The discharged current flows to the photoconductive drum 5 through the stabilizer 21, the grid 23 and the outlet of the grid 23. The electric current I flowed to the grid 23 is grounded through the first varistor 25 resistance 28 and the second varistor 26, however, the grid 23 is controlled to keep a predetermined voltage (hereinafter called grid voltage Vg) by producing a potential difference between the two terminals of the first and second varistors 25, 26.

On the other hand, the condenser 27 is normally kept completely at the discharged condition when copying operation is started, and the grid current I flows to both of the first varistor 25 and the condenser 27 thereby charging the condenser 27. Accordingly, the grid voltage Vg at the time of starting copying operation is decided by the charged voltage of condenser 27 or by the current flowing to the first varistor 25 and the rated voltage of the second varistor 26. Afterward, with the condenser 27 charged, the charged voltage of condenser 27 rises high while current flowing therein decreases, and conversely, the potential difference between the terminals in the first varistor 25 rises thereby increasing the electric current flowing in the first varistor 25. When charging the condenser 27 is finished, the electric current I is flowed to the ground through the first and second varistors 25, 26, and the sum of potential difference of the first and second varistors 25, 26 becomes the grid voltage Vg. The resistance value of resistance 28 is so big that the current flowing therein is small, and therefore, almost no effect is given to potential difference by the first varistor 25.

A concrete set value is shown below as an example.

| | |
|---|---|
| First Varistor Rating | 180 V |
| Second Varistor Rating | 710 V |
| Condenser | 24 μF |
| Resistance | 20 MΩ |
| Grid Current | 10 μA |
| Circumferential Speed of Photoconductive Drum | 350 mm/sec |
| Material of Photoconductive Drum | As2 Se3 |

Figure 4:
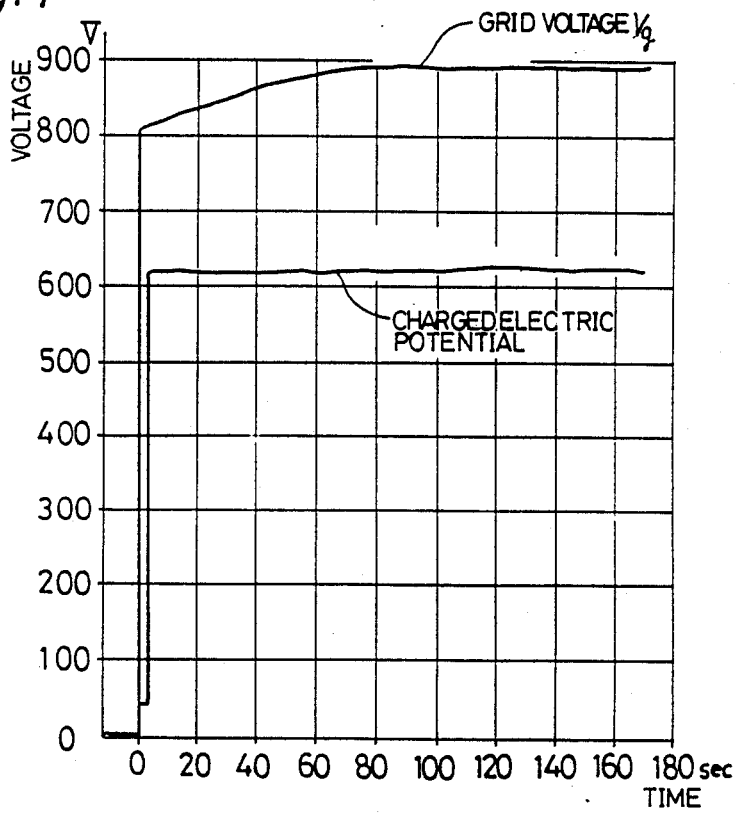
FIG. 4 is a characteristic view showing variable conditions of charged potential and grid voltage in the first embodiment of the present invention.

A test has been conducted under the condition set as above, and the grid voltage Vg and the charged potential Vo of the photoconductive drum 5 at the developing unit became as the ones shown in FIG. 4. As it shows, the grid voltage Vg is gradually rising from initial value of 810V to 890V. When grid voltage Vg is low, discharged current from the charging wire 22 flows more to the grid 23 and flows less to the photoconductive drum 5, and when the grid voltage Vg is risen, discharged current flows from the charging wire to the grid 23 becomes less, and the current decreased flows to the photoconductive drum 5 through the outlet of grid 23.

Figure 3:
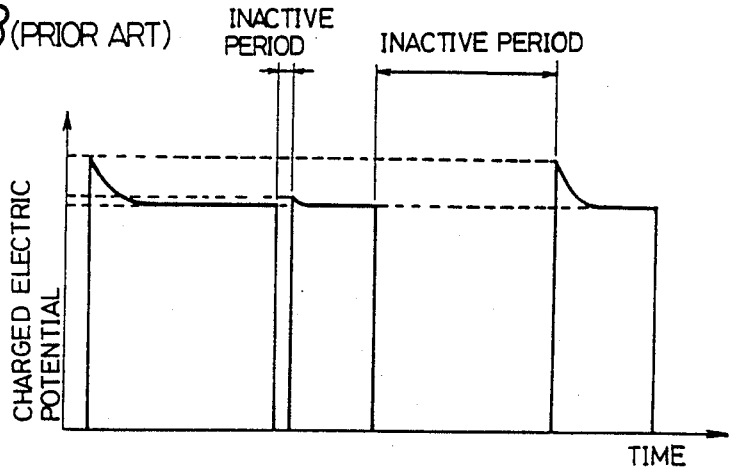
Fig.3 (PRIOR ART)
FIG. 3 is a characteristic view showing variable conditions of charged potential in a conventional device.

Accordingly, when the mechanism of the present embodiment is not applied, higher charged potential is shown at the time of starting copying operation as illustrated in FIG. 3 thereafter gradually lowering to converge on a certain electric potential. However, in the embodiment of the present invention whose initial grid voltage is low and gradually risen toward a predetermined voltage, the charged potential Vo is maintained at a fixed potential from initialization as it is controlled to converge on a fixed voltage as shown in FIG. 4. At this stage, it is important to accurately grasp the electrification characteristic of the photoconductive drum 5 to match to the capacity of the condenser 27. Accordingly, it is necessary to convert the capacity of condenser 27 when the type of photoconductive drum 5, circumferential speed of the photoconductive drum 5, the amount of light erasers, output of the high voltage transformer 24, etc. are subjected to be changed.

When the high voltage transformer 24 is turned off after copying operation is over, corona discharge also stops thereby the grid electric current I stops. Then, the electric charge accumulated in the condenser 27 start electric discharging through resistance 28 connected in parallel. In case when the next copying operation starts during electric discharge is being made, the grid electric current I flowing into the condenser 27 is smaller than when it starts from completely discharged state because there remain electric charge in the condenser 27, and the grid voltage Vg starts from intermediate voltage value between initial voltage and the predetermined voltage.

If the grid voltage Vg is at the predetermined voltage, the charged potential Vo starts at higher electric potential than that of normal time since there still remains light fatigue as to the electrification characteristic of the photoconductive drum 5. However, when the grid voltage Vg starts from the intermediate voltage which is at lower voltage corresponding to the recovery of light fatigue of the photosensitive drum 5 as described above, a fixed charged voltage Vo can always be maintained. The resistance value of resistance 28 may, therefore, be decided for matching the discharging characteristic of condenser 27 with the fatigue recovery characteristic of the photoconductive drum 5 to be used. For instance, when light fatigue of the photoconductive drum 5 is recovered in 30 minutes suspension of machine operation, the resistance value of resistance may be set in accordance with the capacity of condenser 27 which complete discharge in 30 minutes.

Figure 5:
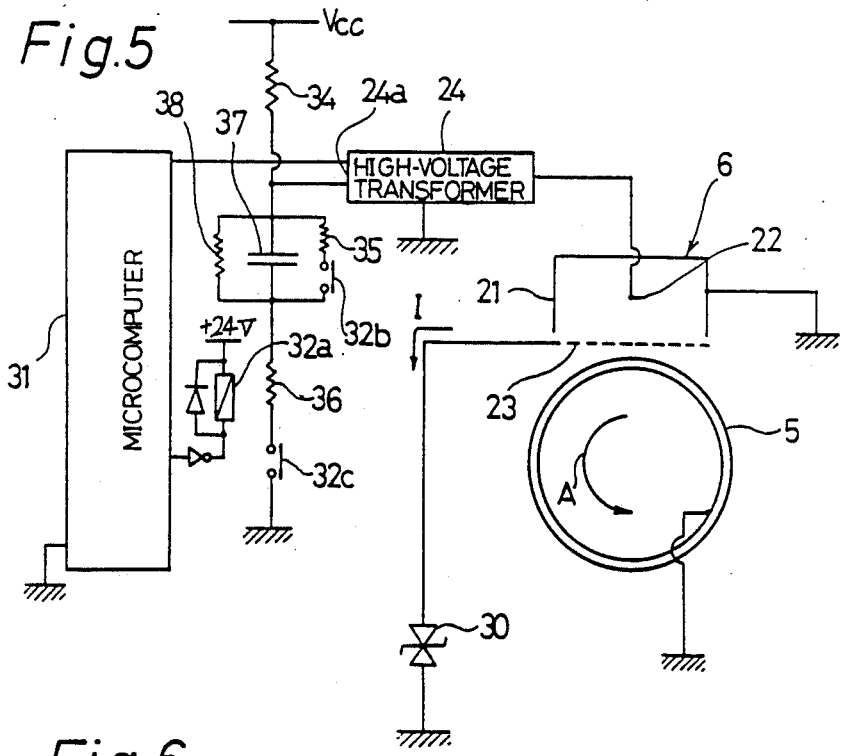
FIG. 5 is a structural view of the charged potential control device of the second embodiment of the present invention.

In the embodiment described above, the mode for controlling the grid voltage is exemplified, however, it may be arranged to control the output voltage of the high voltage transformer 24 by utilizing the same charging/discharging circuit a illustrated in FIG. 5. The grid 23 is grounded through varistor 30 in FIG. 5. The voltage obtained by dividing the standard voltage Vcc by resistance 34 and resistances 35, 36 are inputted into the remote terminal 24*a* of the high voltage transformer 24, said resistances 35, 36 being connected between the remote terminal 24*a* and the earth in series. A condenser 37 for charging and resistance 38 for discharging are connected with the resistance 35 in parallel. To the terminals of resistance 35, 36, relay terminals 32*b* and 32*c* are connected respectively which are switched by current carrying control for relay coil 32*a* by microcomputer 31. Turning off the relay terminal 32*b* prevents the condenser 37 from discharging through the resistance 35 whereas turning off the relay terminal 32*c* prevents the condenser 37 from charging when high voltage transformer 24 is turned off.

In the mechanism described above, current carrying control is done to the relay coil 32*a* by the microcomputer 31, and the relay terminals 32*b* and 32*c* are turned on when the high voltage transformer 24 is in action, and when the high voltage transformer is not in action, the relay terminals 32*b* and 32*c* are turned off. At the starting time, the voltage to be inputted to the remote terminal 24*a* gradually rises during the condenser 37 is being charged, and the voltage divided by the resistance 34, 35 and 36 are inputted when charging is finished. When high voltage transformer 24 is turned off, the condenser 37 is discharged through resistance 38. Thus, by charging/discharging the condenser 37, the voltage to be inputted to the remote terminal 24*a* of the high voltage transformer 24 is controlled which controls the output of voltage thus the same effect as the first embodiment of the present invention can be obtained.

In case where the circuit composing the resistance 35, the relay terminal 32*b*, the condenser 37 and the resistance 38 is connected to the portion between the remote terminal 24*a* of the high voltage transform 24 and the standard voltage Vcc, it may be arranged to lower the output of high voltage transformer following the copying operation and it is advantageously applied to t he photoconductive member whose electric potential rises by continued copying operation or the one whose electric potential has to be adjusted by lowering because of rise of remained electric potential.

A positive characteristic transformer whose output voltage rises when input voltage of the remote terminal 24*a* is raised has been described as the high voltage transformer 24, however, in case of negative characteristic transformer, desired characteristic may be produced by converting combination of circuit.

Figure 6:
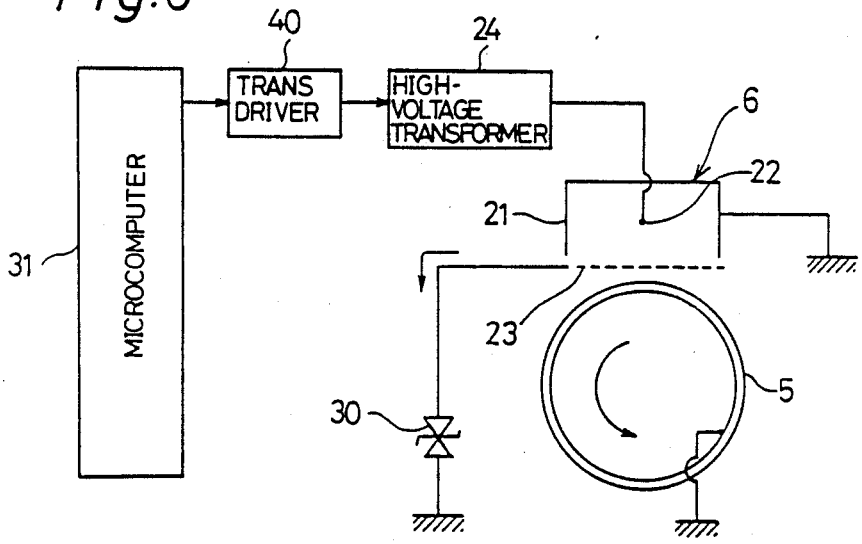
FIG. 6 is a structural view of the charged potential control device of the third embodiment of the present invention.

As shown in FIG. 6, the same arrangement as the first embodiment of the present invention may be made for the charged current control by disposing a transformer driver 40 for controlling the output of transformer 24 which is controlled by the microcomputer 31.

The fourth embodiment of the present invention will now be described with reference to FIGS. 7 through 10.

Figure 7:
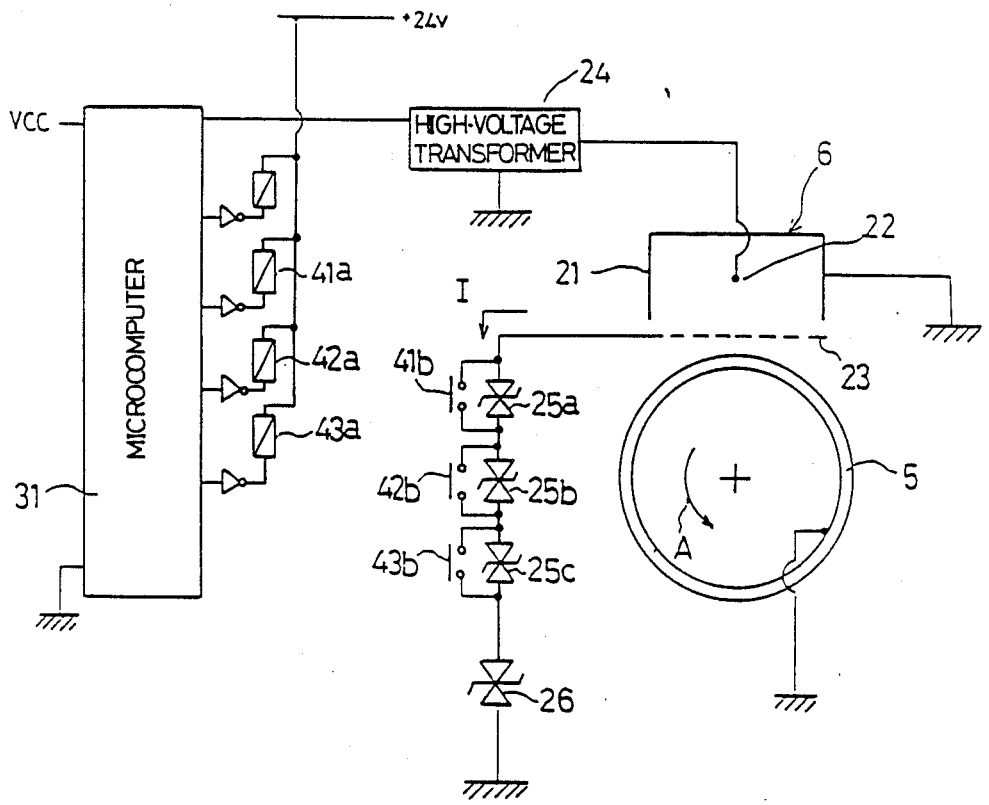
FIG. 7 is a structural view of the charged potential control device of the fourth embodiment of the present invention.

The grid 23 of the charger 6 is grounded through a plurality of first varistors 25*a*, 25*b*, 25*c* and second varistor 26 as shown in FIG. 7. Each of the varistors 25*a*, 25*b*, 25*c* are connected to relay contacts 41*b*, 42*b* and 43*b* in parallel respectively. The grid 23 is provided for the purpose of controlling the charged potential of the photoconductive drum 5 by limiting the amount of electrical charge flowing into the photoconductive drum 5 from the charging wire 22 according to the variation of voltage controlled by the first varistor 25*a*, 25*b*, 25*c* and the second varistor 26. Relay coils 41*a*, 42*a* and 43*a* for actuating the relay contacts 41*b*, 42*b* and 43*b* are connected to the microcomputer 31 which controls the charging wire 22 and the high voltage transformer 24.

In the copying operation, the grid current flowing into the grid 23 is grounded through the first varistors 25*a*, 25*b*, 25*c* and the second varistor 26, however, it controls the grid 23 at a fixed voltage (hereinafter called grid voltage Vg) by producing potential difference between the terminals of the first and second varistors. On the other hand, the relay contacts 41*b*, 42*b* and 43*b* are changeably controlled by behavior control of the microcomputer 31 for the relay coils 41*a*, 42*a* and 43*a* for turning on and off corresponding to light fatigue recovery and the degree of light fatigue. In other words, when there is no light fatigue because of long suspension of machine operation, all the relay contacts 41*b*, 42*b* and 43*b* are connected immediately after the copying operation is started. Accordingly, because of short circuit of all the first varistors 25*a*, 25*b* and 25*c*, the grid current I does not flow in the first varistors 25*a*, 25*b* and 25*c* thereby producing no potential difference between their terminals, and only the electric current being flowed and potential difference being produced between the terminals of the second varistor 26 are impressed to the grid 23.

Thereafter, with the copying operation progresses, the light fatigue of the photoconductive drum 5 increases, and therefore, the short circuit of the first varistor 25*a*, 25*b* and 25*c* is released by the relay contacts 41*b*, 42*b* and 43*b*, and the grid voltage Vg is raised step by step by controlling each one of the relay coils 41*a*, 42*a* and 43*a* so as to convert the rated voltage by the first varistor 25*a*, 25*b* and 25*c*. The conversion of relay contacts 41*b*, 42*b* and 43*b* is to be mad when there is no image forming operation is carried out, for instance, during the time when scanning device is being returned because irregular image density is likely to occur when it is done during the operation of image formation.

The rating for each one of the first varistor 25*a*, 25*b* and 25*c* is set in different value, and by selecting combinations of connections of the relay contacts 41*b*, 42*b* and 43*b*, eight grid voltage Vg may be produced in steps from: $_3C_3+_3C_2+_3C_1+1=8$ When the light fatigue of the photoconductive drum 5 finally became a stationary state, control the relay coils 41*a*, 42*a* and 43*a* so as to release all the relay contacts 41*b*, 42*b* and 43*b*, and convert to become stationary state in which the sum of the first varistor 25*a*, 25*b*, 25*c* and the potential difference of each terminal of the second varistor is impressed to the grid voltage Vg.

A concrete set value is shown below as an example.

| | |
|---|---|
| First Varistor 25a Rating | 45 V |
| 25b Rating | 26 V |
| 25c Rating | 9 V |
| Second Varistor 26 Rating | 810 V |
| Grid Current | Abt. 10 μA |
| Circumferential Speed of Photoconductive Drum | 350 m/sec |

The grid voltage Vg at each step which corresponds to obtainable combination will be as follows:

| Voltage | $S_1$ | $S_2$ | $S_3$ | $S_4$ | $S_5$ | $S_6$ | $S_7$ | $S_8$ |
|---|---|---|---|---|---|---|---|---|
| First Varistor | | | | | | | | |
| 25a (45 V) | — | — | — | — | O | O | O | O |
| 25b (26 V) | — | — | O | O | — | — | O | O |
| 25c (9 V) | — | O | — | O | — | O | — | O |
| Second Varistor | | | | | | | | |
| 26 (810 V) | O | O | O | O | O | O | O | O |
| Grid Voltage | | | | | | | | |
| Vg (v) | 810 | 819 | 836 | 845 | 855 | 864 | 881 | 890 |

Figure 8:
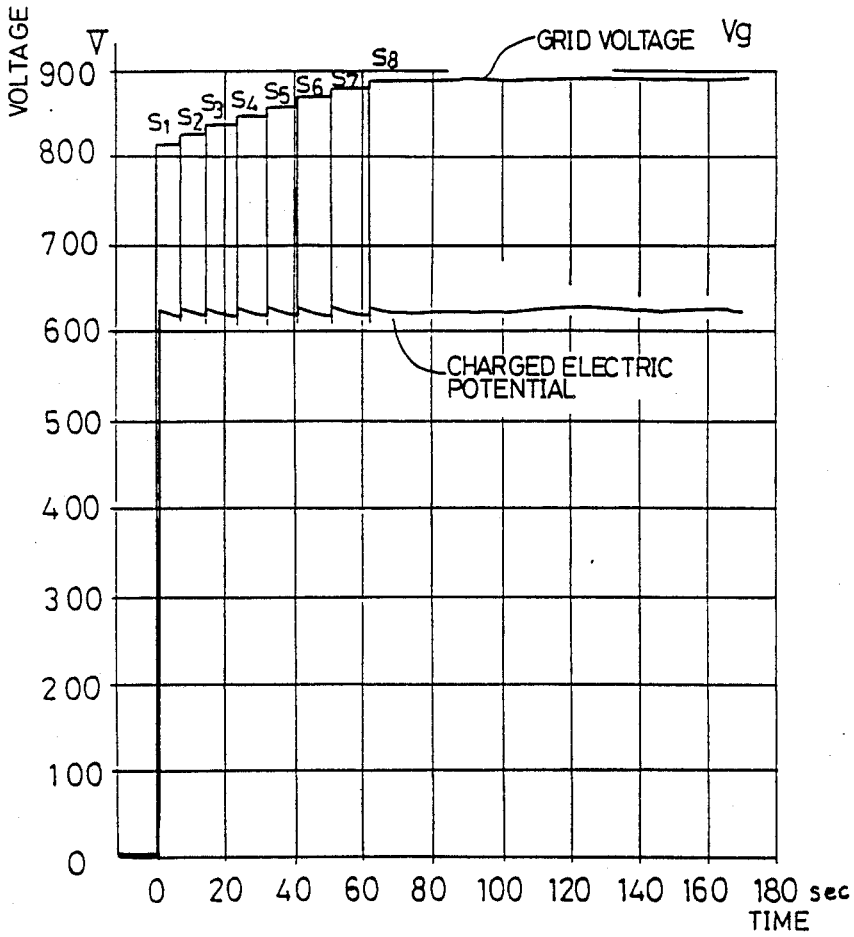
FIG. 8 is a characteristic view showing variable conditions of charged potential and grid voltage in the fourth embodiment of the present invention.

A test has been conducted under the condition set above, and the grid voltage Vg and the charged potential Vo of the photoconductive drum 5 at the developing unit became as the ones shown in FIG. 8. As it shows, the grid voltage Vg is risen from initial value 810V to 890V in 8 steps, i.e. from step $S_1$ to step $S_8$. When grid voltage Vg is low, discharging current from the charging wire 22 flows more to the grid 23 and flows less to the photoconductive drum 5, and when grid voltage Vg is risen, discharged current flows from the charging wire 22 to the grid 23 becomes less, and the current increased flows to the photoconductive drum 5 through the outlet of the grid 23.

Accordingly, when the mechanism of the embodiment of the present invention is not applied, as illustrated in FIG. 3, higher charged potential is shown at the time of starting copying operation thereafter gradually lowering to converge on a fixed electric potential. However, in the embodiment of the present invention, charged electric potential Vo may be maintained almost at a fixed potential though there will be some deviation as shown in FIG. 8 as it is controlled to converge on a fixed voltage wherein initial grid voltage is low and thereafter gradually rising toward the predetermined voltage. At this stage, it is important to accurately grasp the electrification characteristic of the photoconductive drum 5 to match the capacity of each varistor 25*a*, 25*b* and 25*c* and converting timing of relay contacts 41*b*, 42*b* and 43*b* with adjustment of the electrification characteristics. Accordingly, it is necessary to convert the capacity of each varistor 25*a*, 25*b*, 25*c* and 26, and converting timing of relay contacts 41*b*, 42*b* and 43*b* when the type of photoconductive drum 5, circumferential speed of the photoconductive drum 5, the amount of light, output of the high voltage transformer 24, etc. are subject to be changed.

When the copying machine start next copying operation after suspension, the microcomputer 31 readout the time the machine had suspended its action after previous operation and determine a grid voltage Vg at the starting time of copying operation by estimating light fatigue of the photoconductive drum 5. Then, determination is made on the combination of first varistor 25*a*, 25*b* and 25*c* to bring them to the nearest value of the most suitable grid voltage Vg previously decided and connect to the relay contacts 41*b*, 42*b* and 43*b*. As in this case, when the next copying operation is started with light fatigue left on the photoconductive drum 5, grid voltage Vg starts from an intermediate voltage between the voltage at the time of initialization and the voltage at the time of a stable state. When the grid voltage Vg start from an intermediate voltage as in the case described above, the charged potential Vo may always be set at a fixed voltage by setting the grid voltage Vg of the photoconductive drum 5 to become low corresponding to the degree of light fatigue recovery. Accordingly, the capacity of the first varistor 25*a*, 25*b* and 25*c* may be selected to match the grid voltage Vg at the time of starting copying operation with the light fatigue recovery characteristic of the photoconductive drum 5 to be used. For instance, for the photoconductive drum 5 which recovers light fatigue after 30 minutes suspension of operation, it may be arranged to program in the microcomputer 31 to start the capacity of the first varistor 25*a*, 25*b* and 25*c* from the minimum capacity after suspension of 30 minutes and combine the relay contacts 41*b*, 42*b* and 43*b*.

The function explained above will now be described with reference to the flow charts illustrated in FIGS. 9 and 10.

Figure 9:
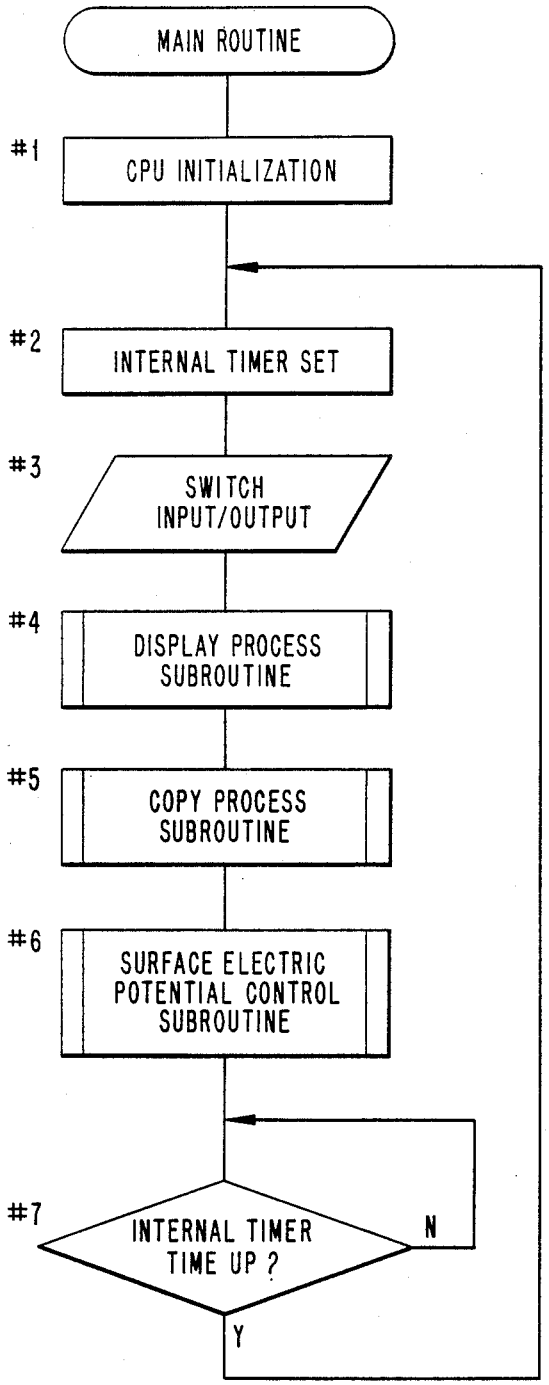
FIGS. 9 and 10 are flow charts of main routine for controlling a microcomputer and subroutine for controlling surface potential in the fourth embodiment of the present invention.

FIG. 9 shows a flow of the whole copying operation. With the start of routine, microcomputer 31 (hereinafter called CPU 31) initializes main routine. The initialize routine includes an action to reset the value of a fatigue counter at 0 which counts the degree of fatigue of the photoconductive drum 5 corresponding to the time spent for copying operation. Then, the CPU 31 sets timer (#2). The timer controls one of the routines of copying operation, for example, it is set at about 10 msec and the time necessary for each one of the procedures is measured basing on this timer. The fatigue counter is arranged to make one increment of counter number every time when the CPU 31 processed one routine. With the light fatigue progresses, when electric potential maintaining capacity of the photoconductive drum 5 stabilize, i.e. after 80 seconds elapsed, the count value becomes 8,000. Succeedingly, the CPU 31 reads signals from each one of the switches and outputs data to each part of the copying machine (#3), and calls subroutine for displaying at operation panel and the like (#4). Then, proper subroutine group for copying operation is called (#5). The subroutine group includes document scanning, transfer sheet feeding and the subroutine for checking the trouble. Thereafter, the CPU 31 calls the subroutine for surface potential control (#6). When the action in each one of the subroutines is finished, the program returns to step #2 after waiting for the finish of the internal timer (#7), thereafter repeats the routine #2-#7.

Figure 10:
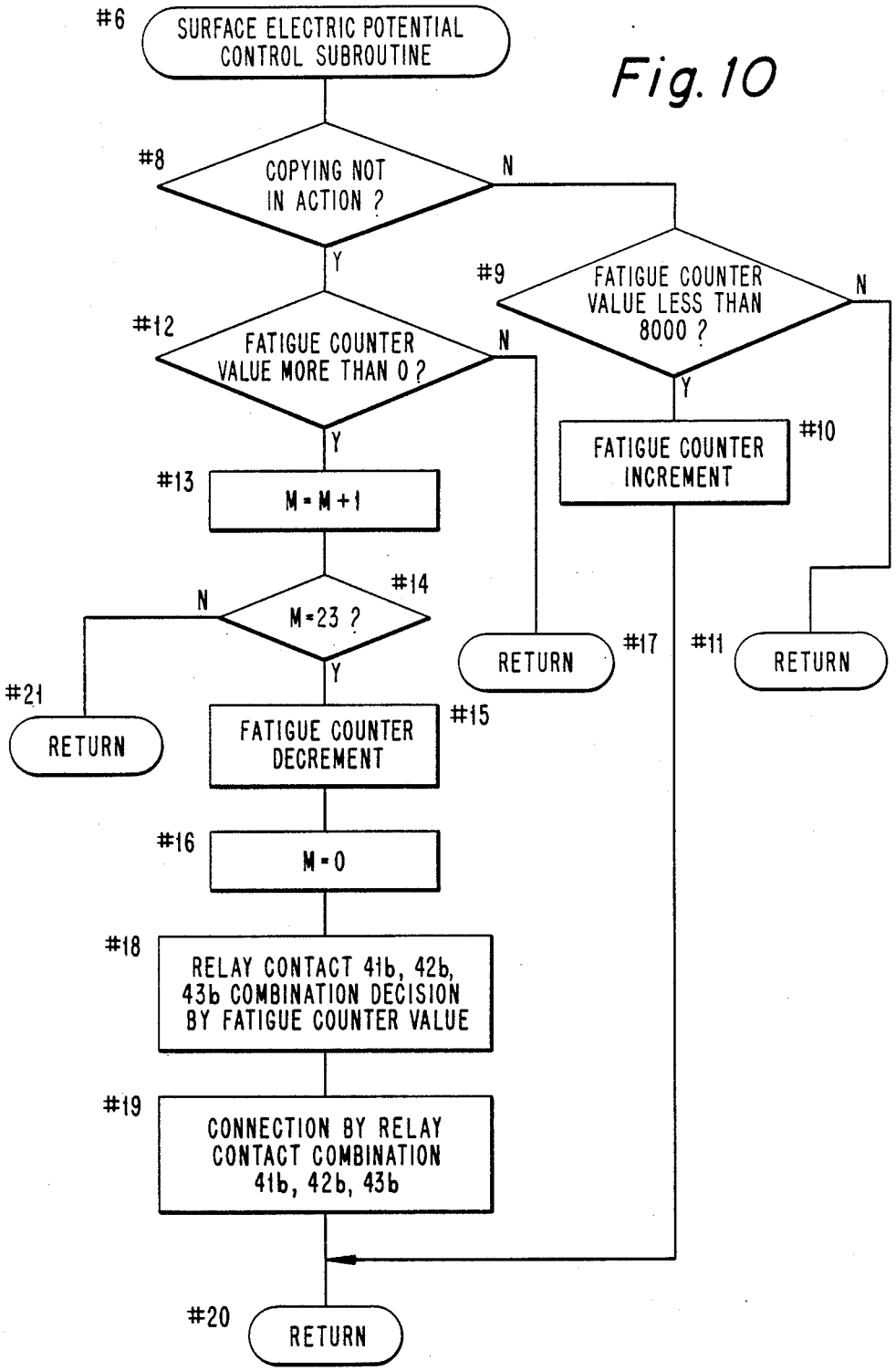

FIG. 10 illustrates a subroutine for controlling the surface potential. In the subroutine, decision is made first as to whether copying operation is in action or not (#8). If copying operation is in action and the value of fatigue counter is less than 8000 (#9), after making an increment to the fatigue counter (#10), the program returns to main routine (#19) and proceed to step #15. If the value of fatigue counter is 8000, the program returns to main routine as it is (#11). The fatigue counter is so arranged as to express fatigue of the photoconductive drum 5 by the value from 0 to 8000 as described above, and the counter value 0 shows the state of non existence of light fatigue and the counter value 8000 shows the state of maximum light fatigue is present. As the light fatigue increase during copying operation, an increment is made to the light fatigue counter, and on the contrary, the work for making decrement of the light fatigue counter is done as light fatigue recovery is made during the copying operation is suspended.

Accordingly, if the copying operation is suspended it is judged whether or not the fatigue counter is more than 0. When the fatigue counter is more than 0, the program increments a counter M and judges whether the counter M is equal to 23 at step #13, #14, respectively. When the counter M reaches 23, step 15 decrements the fatigue counter and step 16 resets the counter M at 0. This means that about 30 minutes, i.e. about 23 times of 80 seconds during which the photoconductive drum 5 reached the maximum light fatigue, is required for recovery of the light fatigue. At step #18, CPU 31 reads fatigue counter value and after calculating the most suitable grid voltage Vg to the value, decision is made on the combination of relay contacts 41*b*, 42*b* and 43*b* (#19) and it returns to main routine (#20).

The surface potential control process is preferably made for each copy sheet in the copying operation. If grid voltage is changed during image forming process, the image density varies in a sheet of copy. Therefore, the conversion of grid voltage is to be preferably made at the time when the charger 6 is charging the portion between images.

The procedure for changing fatigue counter value at step #18 to grid voltage will be supplemented below. As the light fatigue of the photoconductive drum 5 do not change straight forwardly, the charged electric potential is gradually lowered by curving as shown in FIG. 3, and the fatigue at an initial stage is big, and the fatigue at the last stage is small in its ratio of conversion. In the flow chart presently shown, the fatigue counter increase and decrease according to the time spent. It is, therefore, necessary to perform a specific operation for converting the grid voltage.

In the embodiment of the present invention, eight points are provided by dividing the fatigue counter value into seven groups. As to the size of group of fatigue counter, it is arranged that the group which has smaller value is small, and the group which possesses larger value is large. By dividing the fatigue counter value in such a way, at the initial stage of fatigue, the grid voltage Vg is frequently converted according to its ratio of conversion and the ratio of grid voltage becomes large contrary to the phenomena shown at the terminal stage of fatigue. The grid voltage Vg is, therefore, converted at the different step value as shown in FIG. 8 thereby meeting the light fatigue characteristic.

Figure 11:
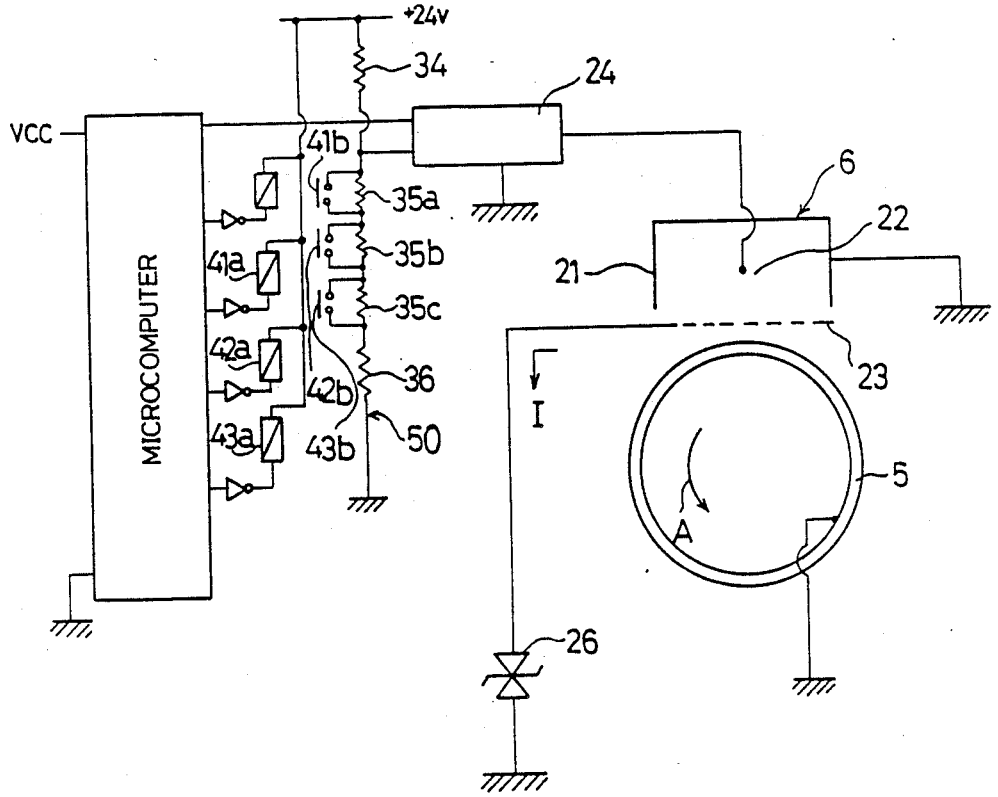
FIG. 11 is a structural view of the charged potential control device of the fifth embodiment of the present invention.

It may also be arranged to control the charged potential as described above by providing transformer driver 50 which controls the output of high voltage transformer 24 and is controlled by the microcomputer 31 as shown in FIG. 11. In the fifth embodiment of the present invention, transformer driver 50 is arranged by providing between the remote terminal 24*a* and the resistance 36, three resistance 35*a*, 35*b* and 35*c* which control the output of transformer and they are connected with relay contacts 41*b*, 42*b* and 43*b* in parallel. The divided voltage between the resistance 34 and the resistances 35*a*, 35*b*, 35*c*, 36 is impressed to the remote terminal 24*a* of the high voltage transformer 24. Each relay contacts 41*b*, 42*b* and 43*b* are controlled for turning on and turning off by relay coils 41*a*, 42*a* and 43*a* which are connected with the microcomputer 31. The microcomputer 31 controls in stages the output of high voltage transformer 24 by converting the combination of connection of each resistance 35*a*, 35*b* and 35*c*. As a consequence, it may become possible to always maintain charged potential on the photoconductive drum 5 at a fixed value by controlling the output of the high voltage transformer 24 corresponding to the suspended time of the copying machine and the time spent for copying operation just the same as the first embodiment of the present invention.

Figure 12:
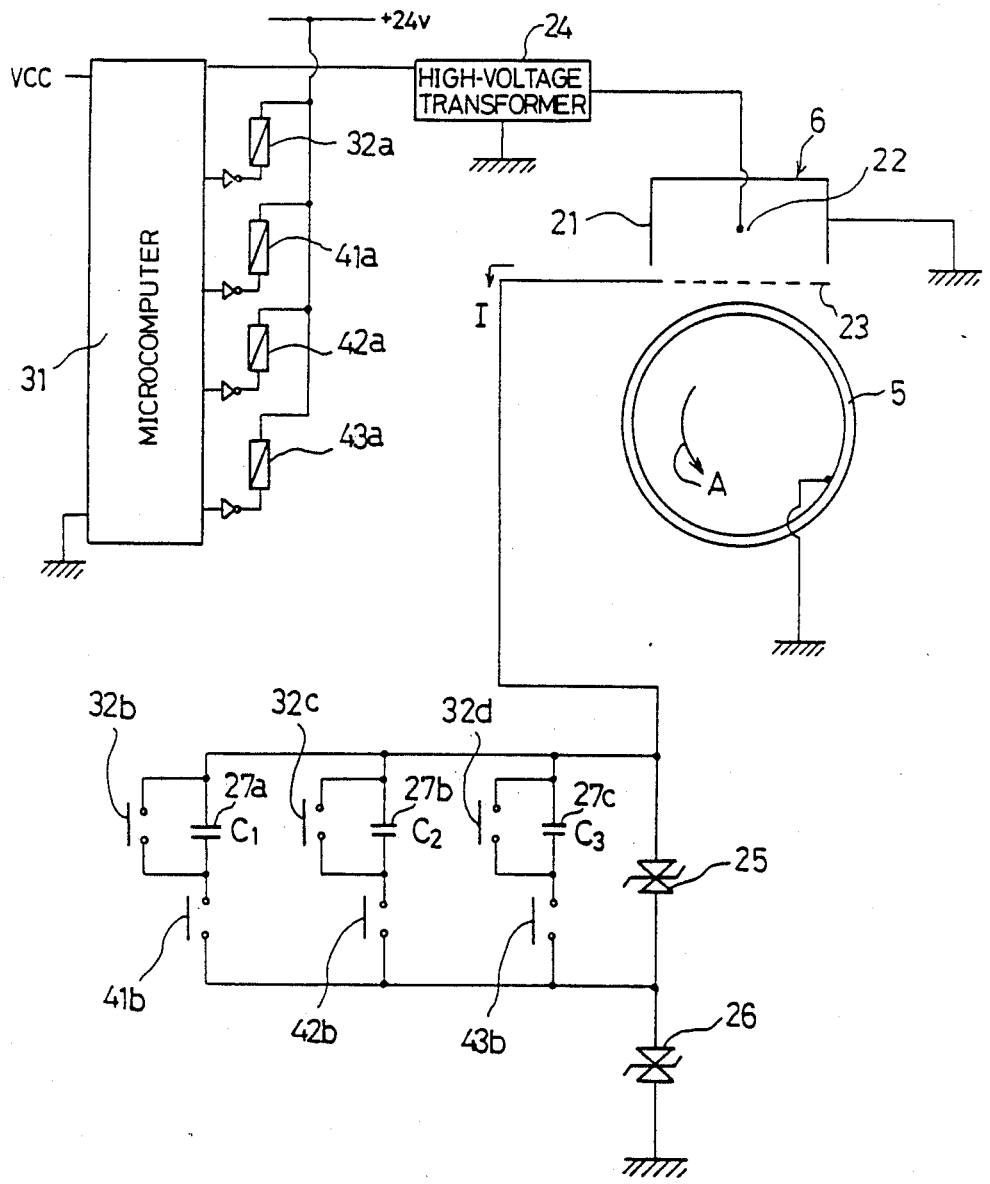
FIG. 12 is a structural view of the charged potential control device of the sixth embodiment of the present invention.
Figure 13:
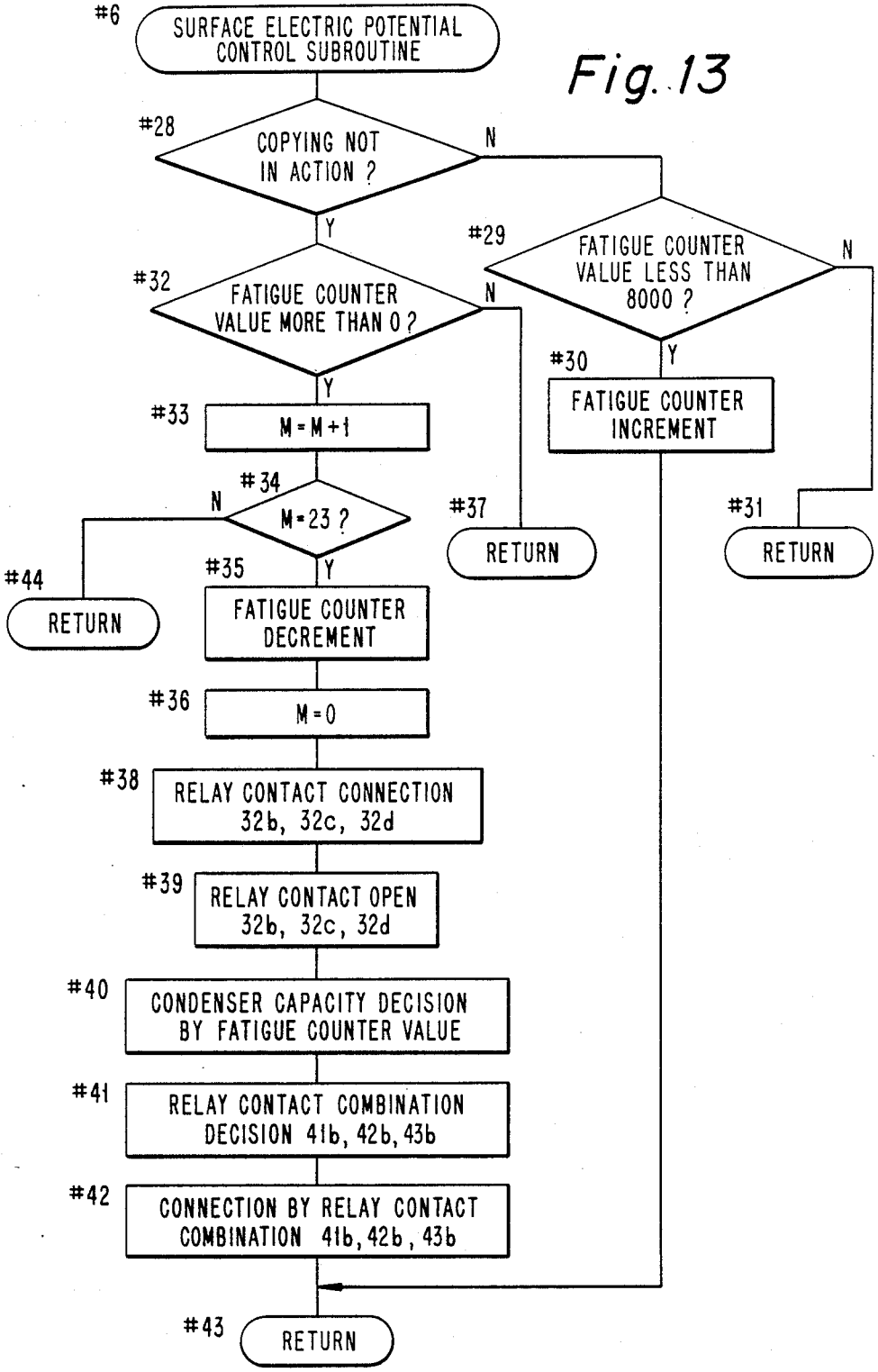
FIG. 13 is a flow chart of subroutine for controlling surface potential in the sixth embodiment of the present invention.

The sixth embodiment of the present invention as illustrated in FIGS. 12 and 13 is designed to control grid voltage Vg of the grid 23 just the same as the first embodiment of the present invention, and only the difference is that the grid 23 is grounded through the first varistor 25 and the second varistor 26 connected in series. The first varistor 25 is connected in parallel with a group of three circuits, each of which comprises a condenser and two relay contacts. The relay contacts 32*b*, 32*c*, 32*d*, which are switched by relay coil 32*a* controlled by the microcomputer 31, are connected in parallel with the condensers 27*a*, 27*b*, 27*c*, respectively. The relay contacts 41*a*, 42*a*, 43*a* are connected in series with the condenser 27*a*, 27*b*, 27*c* respectively and are switched by relay coils 41*a*, 42*a*, 43*a* controlled by the microcomputer 31. The grid current I flowing in the grid 23 is grounded through the first varistor 25 and the second varistor 26, however, the grid 23 is controlled to be at a predetermined grid voltage Vg by producing potential difference between the terminals of the first varistor 25 and the second varistor 26. On the other hand, the relay contacts 41*b*, 42*b* and 43*b* are converted by the microcomputer 31 corresponding to the time of suspension of the copying machine, i.e. the fatigue recovery. For instance, if the period of the machine suspension is long and if there is no fatigue, all the relay contacts 41*b*, 42*b* and 43*b* are connected. The capacity of condenser C becomes the maximum at this point as follows: $C=C_1+C_2+C_3$ The capacity of the condensers 27*a*, 27*b* and 27*c* are set in different value each other, i.e. $C_1$, $C_2$ and $C_3$. Eight steps of condenser capacity may be produced by selecting the combination of connections of the relay contacts 41*b*, 42*b* and 43*b* as shown below:

$$_3C_3+{}_3C_2+{}_3C_1+1=8$$

The condensers 27*a*, 27*b* and 27*c* are shortcircuited by the relay contacts 32*b*, 32*c* and 32*d* when the copying operation is suspended. Accordingly, they are under completely discharged state when copying operation starts, and grid current I flows to both the first varistor 25 and the condensers 27*a*, 27*b* and 27*c* thereby charging the condensers 27*a*, 27*b* and 27*c*. The grid voltage Vg at the starting time of copying operation is, therefore, decided either by the charged voltage of condensers 27*a*, 27*b*, 27*c* or by the current flowing to the first varistor 25 and the rated voltage of the second varistor 26. Thus, the condensers 27*a*, 27*b* and 27*c* are charged, the charged voltage of the condenser 27 becomes high while decreasing current inflow and conversely, potential difference between both the terminals of the first varistor 25 rises and the current flowing into the first varistor increases. Finally, when charging of the condensers 27*a*, 27*b* and 27*c* is finished, the grid current I flows through the first and second varistors 25, 26 to the ground and the sum of potential difference between the first and second varistors 25,26 becomes grid voltage Vg.

As an example, a concrete set value is shown below.

| | |
|---|---|
| Material of Photoconductive Drum 5 | As2 Se3 |
| First Varistor Rating | 18 V |
| Second Varistor Rating | 710 V |
| Condenser 27a | 13.5 μF |
| Condenser 27b | 8.0 μF |
| Condenser 27c | 2.5 μF |
| Grid Current | abt. 10 μA |
| Circumferential speed of photoconductive drum 5 | 350 mm/sec |

A test has been conducted under the condition set as above, the grid voltage Vg and the charged potential Vo at the developing unit of the photoconductive drum 5 became as like the ones shown in FIG. 4 in the first embodiment of the present invention. Then, when next operation of the condensers 27*a*, 27*b* and 27*c* starts after the copying machine suspended its operation, microcomputer 31 readout the time the machine suspended its operation, estimate the degree of fatigue of the photoconductive drum 5, decide the combination of condensers 27*a*, 27*b* and 27*c* so as to suit the capacity of the condensers to the degree of fatigue and thereby connects to each one of the relay contacts 41*b*, 42*b* and 43*b* according to the result. By deciding the capacity of condensers as above, the grid voltage Vg starts from an intermediate voltage between the voltage at the initial starting time and the voltage a the time of stable state.

For maintaining charged potential Vo at a certain value, it may be arranged to select capacity of the condensers 27*a*, 27*b* and 27*c* so as to have the grid voltage Vg at the starting time match to the light fatigue recovery characteristic of the photoconductive drum 5 to be used. For instance, in case when the light fatigue of the photoconductive drum 5 is recovered in 30 minutes, it may be arranged to make combination of the relay contacts 41*b*, 42*b* and 43*b* for starting with maximum capacity of condensers after 30 minutes suspension of machine operation.

The main routine controlled by the microcomputer 31 in this embodiment of the present invention is just the same as that of the fourth embodiment, and therefore, the description and drawing are omitted. There are, however, some difference in the subroutine on the surface potential control of the main routine, which will now be described referring to the flow chart in FIG. 13.

After completing the process of fatigue counter corresponding to the process whether. copying is in action or not and also whether counter M reaches 23 or not at step #28 to #37, as in step #8–#17 in FIG. 10 of the fourth embodiment of the present invention, relay contacts 32*b*, 32*c* and 32*d* are connected and open again (#38, #39), and have the condensers 27*a*, 27*b* and 27*c* completely discharged condition. Then, the most suitable capacity of condenser is decided against fatigue counter value (#40). The combination of relay contacts 41*b*, 42*b* and 43*b* are decided against the most suitable capacity of condenser (#41) basing on which connection of relay contacts 41*b*, 42*b* and 43*b* is made (#42), thereafter the program returns to main routine (#43).

Figure 14:
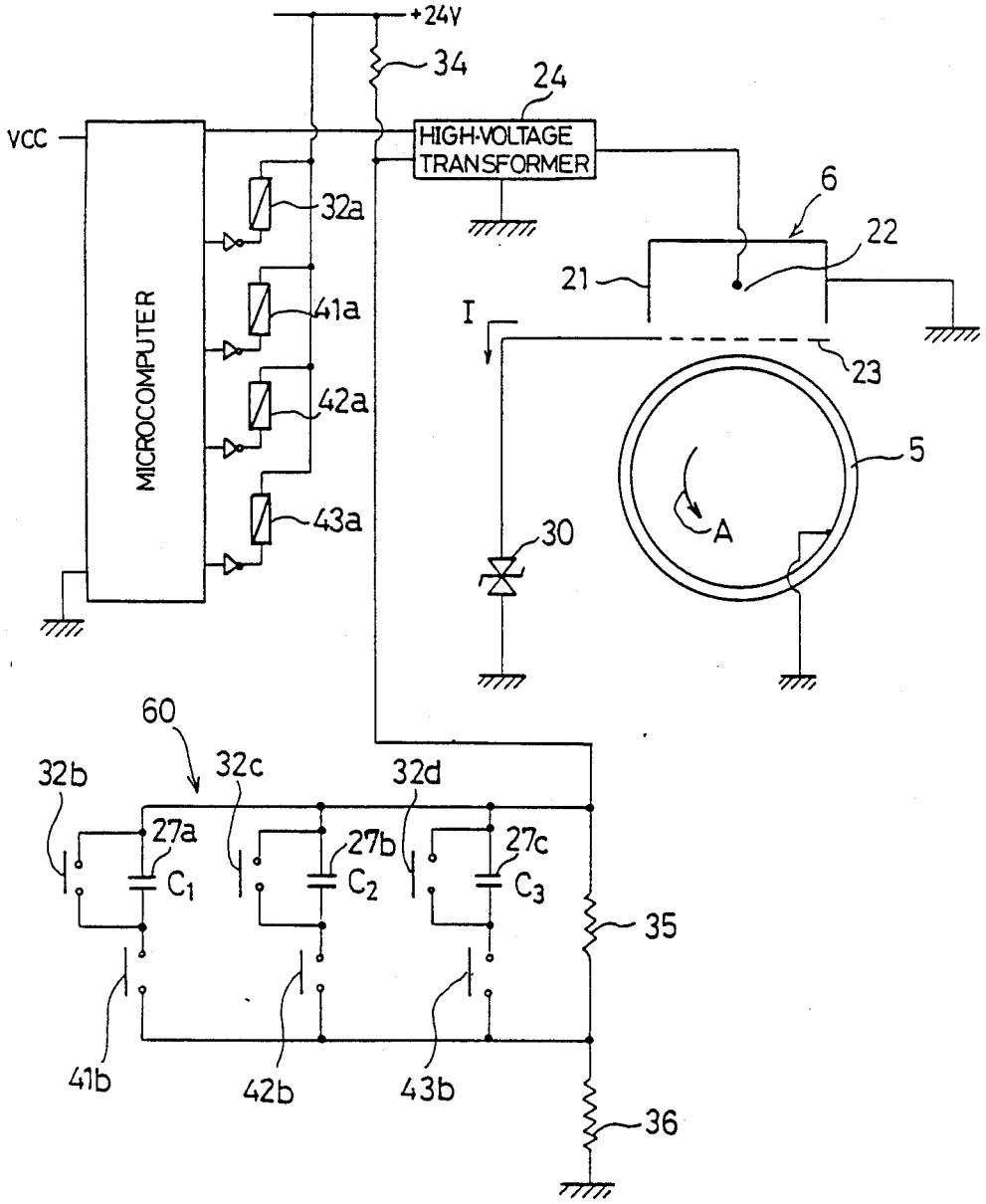
FIG. 14 is a structural view of the charged potential control device of the seventh embodiment of the present invention.

In the seventh embodiment of the present invention illustrated in FIG. 14, just the same as the second embodiment, three condensers 27*a*, 27*b* and 27*c* are utilized as in the sixth embodiment of the present invention in order to always obtain a predetermined charged potential by controlling a charged potential corresponding to the time the copying operation is not in action and the charging characteristic of the photoconductive drum 5 in the copying operation. The condensers 27*a*, 27*b* and 27*c* are connected in parallel with resistance 35 which is one of three resistance connected in series each other to decide the applied voltage to the high voltage transformer 24 in transformer driver 60. The condensers 27*a*, 27*b* and 27*c* are also connected in parallel against the resistance 35 with the relay contacts 32*b*, 32*c* and 32*d* and in series with the relay contacts 41*b*, 42*b* and 43*b* respectively. The relay contacts 32*b*, 32*c*, 32*d*, 41*b*, 42*b* and 43*b* are controlled by relay coils 32*a*, 41*a*, 42*a* and 43*a* of the microcomputer 31, as in the case of the sixth embodiment of the present invention, to make the charged potential of the photoconductive drum 5 at a desired value by controlling the output of the high voltage transformer 24 according to the time when copying operation is not in action and also to the time being spent in the copying operation.

What is claimed is:

1. An image forming apparatus, comprising: photoconductive member;

means for charging the surface of the photoconductive member;

means for forming electrostatic latent image on the photoconductive member by exposing images;

means for developing the electrostatic latent image;

means for actuating the charging means; and control means for controlling output of the charging means to start with a different value from a predetermined value when the charging means is actuated and gradually make the value to match up to the predetermined value.

2. An image forming apparatus as claimed in claim 1, wherein the charging means includes a wire electrode provided for discharging and a grid electrode disposed between the wire electrode and the photoconductive drum, and the control means includes a varistor disposed between the grid electrode and the ground, and condensers disposed in parallel with the varistor.

3. An image forming apparatus as claimed in claim 2, wherein the control means includes a second varistor disposed between the first varistor and ground.

4. An image forming apparatus as claimed in claim 2, wherein the control means includes electric resistance paralleled with the varistor.

5. An image forming apparatus as claimed in claim 2, wherein the means for actuating the charging means is a high voltage transformer connected to the wire electrode provided for discharging charging means, and is controlled by a microcomputer.

6. An image forming apparatus as claimed in claim 5, wherein the high voltage transformer is controlled by a microcomputer through a transformer driver.

7. An image forming apparatus, comprising: photoconductive drum;

means for charging the surface of the photoconductive drum;

means for forming electrostatic latent image on the photoconductive drum by exposing images;

means for developing the electrostatic latent image;

means for actuating the charging means; and control means for controlling output of the charging means to start with a lower value than a predetermined value according to the time during which the charging means suspended its operation and to gradually make the value to match up to the predetermined value.

8. An image forming apparatus as claimed in claim 7, wherein the charging means includes a wire electrode provided for discharging and a grid electrode disposed between the wire electrode and the photoconductive drum, and the control means controls electric potential of the grid electrode.

9. an image forming apparatus as claimed in claim 8, wherein the control means includes a plurality of first varistors disposed between the grid electrode and ground and a plurality of relay contacts disposed in parallel with a plurality of the first varistors, and relay coils for actuating each relay contact.

10. An image forming apparatus as claimed in claim 9, wherein the means for actuating the charging means is a high voltage transformer connected to the wire electrode, and is controlled by a microcomputer.

11. An image forming apparatus as claimed in claim 10, wherein the high voltage transformer is controlled by the microcomputer through a transformer driver.

12. An image forming apparatus as claimed in claim 8, wherein the control means includes the first and second varistors disposed in series between the grid electrode and ground, a plurality of condensers paralleled with the first condenser, first relay contacts disposed in parallel with each one of the condensers, second relay contacts disposed in series with each one of the condensers, and relay coils for actuating each relay contacts.

13. An image forming apparatus as claimed in claim 12, wherein the means for actuating the charging means is a high voltage transformer connected to wire provided for discharging and is controlled by a microcomputer.

14. An image forming apparatus as claimed in claim 13, wherein the high voltage transformer is controlled by the microcomputer through a transformer driver.

* * * * *